US005689775A

United States Patent [19]

Marumoto

[11] Patent Number: 5,689,775

[45] **Date of Patent: *Nov. 18, 1997**

[54] TRANSFER DEVICE CONFIGURATION IN AN IMAGE-REPRODUCING STATION

[75] Inventor: Takeshi Marumoto, Osaka, Japan

[73] Assignee: Mita Industrial Co., Ltd., Osaka, Japan

[ * ] Notice: The term of this patent shall not extend beyond the expiration date of Pat. No. 5,614,997.

[21] Appl. No.: 582,316

[22] Filed: Jan. 3, 1996

[30] Foreign Application Priority Data

Jan. 10, 1995 [JP] Japan ..... 7-002134

[51] Int. Cl.[6] ..... G03G 15/16

[52] U.S. Cl. ..... 399/121; 399/125; 399/315

[58] Field of Search ..... 355/200, 210, 355/271, 219, 221; 361/221, 214; 399/121, 125, 315

[56] References Cited

U.S. PATENT DOCUMENTS

| | | | |
|---|---|---|---|
| 4,809,033 | 2/1989 | Ikemoto et al. | 355/271 |
| 4,896,191 | 1/1990 | Ohyabu et al. | 355/271 X |
| 5,138,396 | 8/1992 | Satou et al. | 355/271 X |
| 5,317,371 | 5/1994 | Monma et al. | 355/271 X |
| 5,552,873 | 9/1996 | Hirao et al. | 355/271 X |

*Primary Examiner*—Arthur T. Grimley
*Assistant Examiner*—Sophia S. Chen
*Attorney, Agent, or Firm*—Shinjyu Office of Patent Attorneys

[57] ABSTRACT

In an imaging station of a photocopier, a transfer device is provided in configuration with a photosensitive drum 7. The transfer device is provided with a discharge wire 24 located opposite the photosensitive drum 7, a housing 26, a charge removing member 51, and a shield frame 25. The housing 26 has a pair of insulating blocks 40 supporting either end of discharge wire 24, and a connecting shank 41 formed integrally with and extending between the pair of insulating blocks. The charge removing member 51 is fitted to the shank 41 and removes image-transferring electrical charge from the reverse side of a sheet passed by a sheet supply transport device 15 through the imaging station. The shield frame 25 is formed to at least partially surround the discharge wire 24, and has an opening 30*a* on the side facing photosensitive drum 7, into which support housing 26 is fitted.

6 Claims, 6 Drawing Sheets

TRANSFER DEVICE CONFIGURATION IN AN IMAGE-REPRODUCING STATION

BACKGROUND OF THE INVENTION

A. Field of the Invention

The invention relates to image reproducing devices having a photosensitive drum which holds a toner image on an outer surface thereof, and more particularly, the invention relates to a transfer device which transfers the toner image held by the photosensitive drum to paper passed through the image reproducing device.

B. Description of the Related Art

In a photocopier device or similar image reproducing device, a transfer device is typically provided for transferring the toner image formed on the surface of a photosensitive drum to a sheet which is fed through the photocopier device from an upstream end of the photocopier to a downstream side, with a photosensitive drum disposed therebetween. The transfer device generally has a shield frame having a cross section in the shape of an open square. The shield frame is typically positioned along the axis of the photosensitive drum with an opening for a discharge wire. The discharge wire is disposed along the length of the shield frame, and is supported on a pair of insulating blocks. The insulating blocks are usually located at opposite ends of the shield frame. With a transfer device of this type, when a high voltage is applied to the discharge wire, a corona discharge is brought about on the reverse of the sheet by means of the discharge wire as the sheet passes through the transfer device. As a result the toner image formed on the surface of the drum is transferred to the sheet.

Furthermore a separator device is provided at the bottom side of the transfer device downstream from the photosensitive drum, to separate the sheet from the photosensitive drum. One commonly known type of separator device includes a charge removing needle which separates the sheet from the photosensitive drum by removing the electrical charge from the sheet.

In some photocopiers where a charge removing needle is used as a separator device, the charge removing needle is fitted as a separate member to the transfer device. In other photocopiers, the charge removing needle is installed as a part of the transfer device. With compact photocopiers in particular, since the diameter of the photosensitive drum is small, the charge removing needle is commonly installed as a part of the transfer device since it is necessary to locate the charge removing needle adjacent to the discharge wire used for transfer.

Transfer devices which are fitted with a charge removing needle require that the charge removing needle be insulated from the shield frame. Hence, a resin member is located along the side wall of the shield frame with the charge removing needle attached to the resin member. The resin member is fixed to the pair of insulating blocks supporting the discharge wire by means of machine screws or the like.

Here, since a high AC voltage is applied to the charge removing needle, if the charge removing needle is too close to the discharge wire, the AC voltage will have an adverse effect on the charge removing process, with the danger that the image transferred onto the sheet will be adversely affected. However, since with compact photocopiers it is not generally possible to separate the discharge wire and the charge removing needle by a large distance, it is necessary to carefully maintain the gap between the two.

Since conventional transfer devices fitted with charge removing needles are typically arranged with a resin member, and the resin member supported on insulating blocks which also support the discharge wire, the problem occurs that with an accumulation of dimensional errors in the members it is very difficult to ensure a high degree of accuracy in the gap between the discharge wire and the charge removing needle. The dimensional errors may be due to inconsistencies in manufacturing, assembling imperfections or may be due to warpage in materials or the like.

Furthermore, the gap between the charge removing needle and the photosensitive drum has a great effect on the ability to separate the sheet, so it is necessary to carefully control the gap between the two. However, although it is possible with conventional transfer devices to easily ensure accurate control of the gap between the photosensitive drum and the discharge wire using a positioning mechanism, it is very difficult to set the gap between the photosensitive drum and the charge removing needle with a high degree of accuracy.

SUMMARY OF THE INVENTION

One object of the present invention is to easily and accurately maintain the gap between the discharge wire and the charge removing member in a clam-shell type image forming device.

Another object of the invention is to easily and accurately maintain the gap between the image holder and the charge removing member.

In one aspect of the present invention, an image reproducing device includes a frame. An image forming element is supported within the frame. A sheet supply device supported in the frame transports sheets to the image forming element. A transfer device is disposed between the sheet supply device and the image forming element. The transfer device includes: a shield frame supported within the image reproducing device; a housing formed with a pair of insulating blocks; and a connector extending between the insulating blocks, the connector and the insulating blocks formed integrally as a single element. The housing is supported within a portions of the shield free. A discharge wire extends between the insulating blocks and supported by the insulating blocks. The discharge wire is positioned proximate the image forming element, and a portion of the shield frame shaped to at least partially surround the discharge wire. The transfer device further includes a charge removing member fitted to the connector.

Preferably, the image reproducing device further includes a registration roller supported in the frame such that a portion of the shield frame engages the registration roller such that the shield frame is constrained for limited pivotal movement about the registration roller. Further, a positioning mechanism within the frame supports the shield frame for limited pivotal movement about the registration roller, thus maintaining a predetermined gap between the image forming element and the discharge wire.

Preferably, the positioning mechanism engages a contact part formed in a portion of the housing and the positioning mechanism contacts a portion of the image forming element, and the positioning mechanism also includes a spring member which urges the housing and the shield frame toward the image forming element.

Preferably, the frame includes a lower body part which supports the transfer device and an upper body part hinged to the lower body part, the upper body part supporting the image forming element.

Preferably, the transfer device further includes a sheet transport guide member fitted to the connector so as to be freely removable, the charge removing member being supported between the connector and the sheet transport guide member.

In another aspect of the present invention, an image reproducing device includes a frame having a lower body part and an upper body part configured to open and close freely with respect to the lower body part. An image data capturing means is supported within the frame which captures image data. An image-forming part is supported in the upper body part and includes a photosensitive drum. A sheet supply device is disposed within the lower body part. A transfer device body is supported in the lower body part and is positioned to be opposite the photosensitive drum when the upper body part is in a closed position with respect to the lower body part, the transfer device body configured to pivot about a registration roller supported in the lower body part. A positioning mechanism within the lower body part supports the transfer device body. A fixing device is supported in the lower body part downstream of the transfer device body. The transfer device body includes:

a shield frame supported within the image reproducing device;

a housing formed with a pair of insulating blocks and a connector extending between the insulating blocks, the connector and the insulating blocks formed integrally as a single element, the housing supported within a portion of the shield frame;

a discharge member extending between the insulating blocks and supported thereby, the discharge wire positioned proximate the image forming element, and a portion of the shield frame shaped to at least partially surround the discharge wire; and a charge removing member fitted to the connector;

and the positioning mechanism maintains a predetermined gap between the photosensitive drum and the discharge wire.

During operation of the image reproducing device, a toner image formed on the surface of the image forming element is transferred to sheets transported by the sheet supply device. The sheet to which the toner image is transferred has its electrical charge removed by the charge removing member, and is separated from the image forming element. The insulating blocks which support the discharge wire and the connector to which the charge removing member is fitted are formed integrally. As a result, compared to the prior art where the member corresponding to the connector is fitted to separate insulating blocks, it is easy maintain the gap between the discharge wire and the charge removing member to a high degree of accuracy. Moreover if the position of the image forming element and the discharge wire is determined, the position of the gap between the image forming element and the charge removing member will be determined, and it is easy to set the gap between the two to a high degree of accuracy.

With the transfer device in accordance with the present invention, one end of the shield frame is supported so as to freely rotate about the lower registration roller and another end of the shield frame is positioned by the positioning mechanism. As a result the gap between image forming element and the discharge wire can be simply maintained within a predetermined distance.

Further, part of the image forming element is in contact with part of the housing of the transfer device. The housing and the shield frame are urged toward the image forming element to facilitate maintenance of the predetermined gap between the image forming element and the discharge wire.

Since the body of the image-forming device includes a lower body part which supports the transfer device and the upper body part which supports the image forming element so that it opens and closes freely with respect to the lower body part, the image forming element and the transfer device housing come into contact upon the closing of the upper body part, thus providing a means for determining the position of between the transfer device and the image forming element.

The sheet transport guide member is attached to said connector so as to be freely removable, and after image transfer, the sheet is guided by the guide member and carried downstream and out of the image reproducing device. The charge removing member is fixed between the connector and the guide member, and thus the charge removing member is attached by means of a very simple structure compared to the prior art.

These and other objects, features, aspects and advantages of the present invention will become more fully apparent from the following detailed description of the present invention when taken in conjunction with the accompanying drawings where like reference numerals denote corresponding parts throughout, in which:

DETAILED DESCRIPTION OF THE PREFERRED EMBODIMENTS

Figure 1:
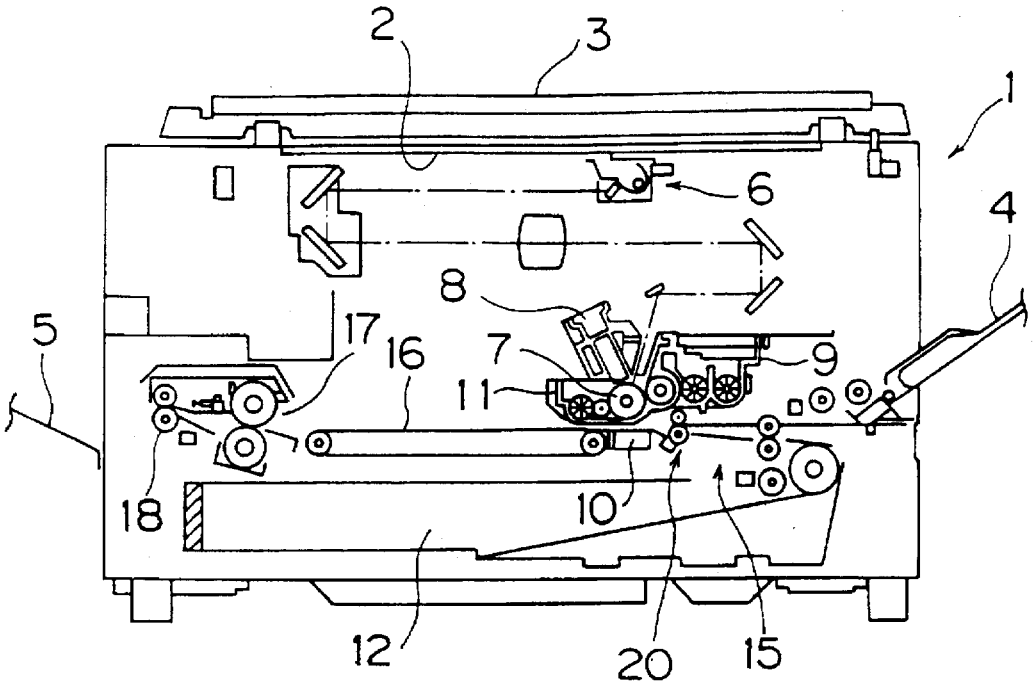
FIG. 1 is a side cross section, schematic view of a clam-shell type photocopier in accordance with one embodiment of the present invention.
Figure 2:
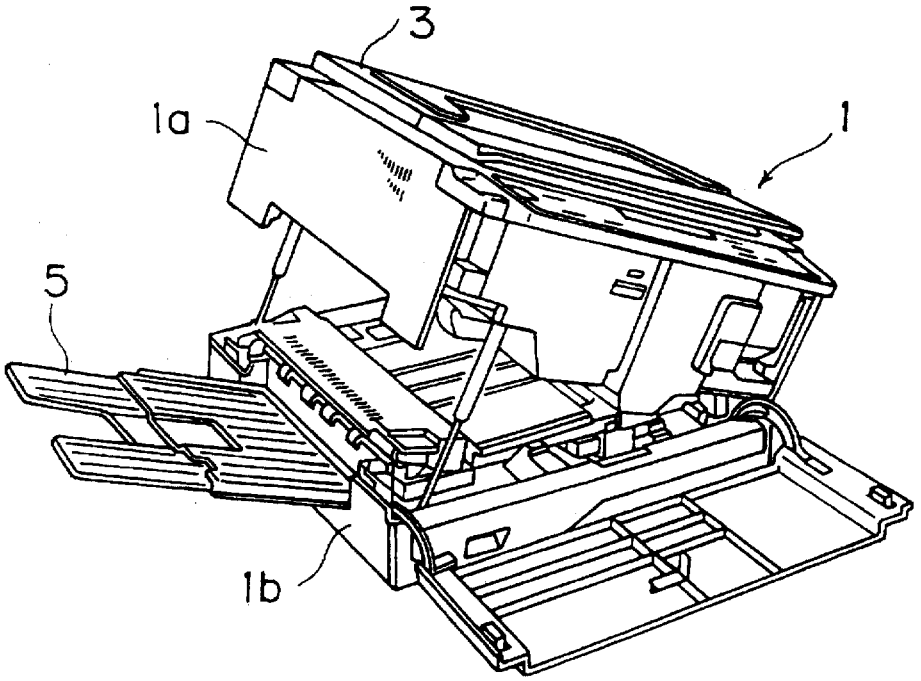
FIG. 2 is a perspective view of the photocopier depicted in FIG. 1, showing the photocopier in the open position.

FIGS. 1 and 2 depict a clamshell-type photocopier in which a transfer device in accordance with an embodiment of the present invention is employed. In the figures, a document table 2 is shown fixed in the upper surface of photocopier 1, where a document holder 3 is hinged for opening and closing onto the top of the document platform 2. On the right-hand side of photocopier 1 in the FIG. 1 a manual sheet supply tray 4 is fitted, and on the left-hand side thereof in the FIG. 1 a discharge tray 5 is fitted, into which processed copy sheets are sent.

Exposure device 6 for reading document originals is provided in the upper interior of the photocopier 1. A photo-sensitive drum 7 for developing a toner image in correspondence with exposure of a document original is disposed in the middle of the photocopier 1 interior. Further, a main charging device 8, a developer 9, a transfer device 10 and a cleaning device 11 are disposed surrounding photo-sensitive drum 7, and together with the photo-sensitive drum 7 form an imaging station. Also, a copy sheet feed cassette 12 is provided in the lower interior of the photocopier 1.

Figure 3:
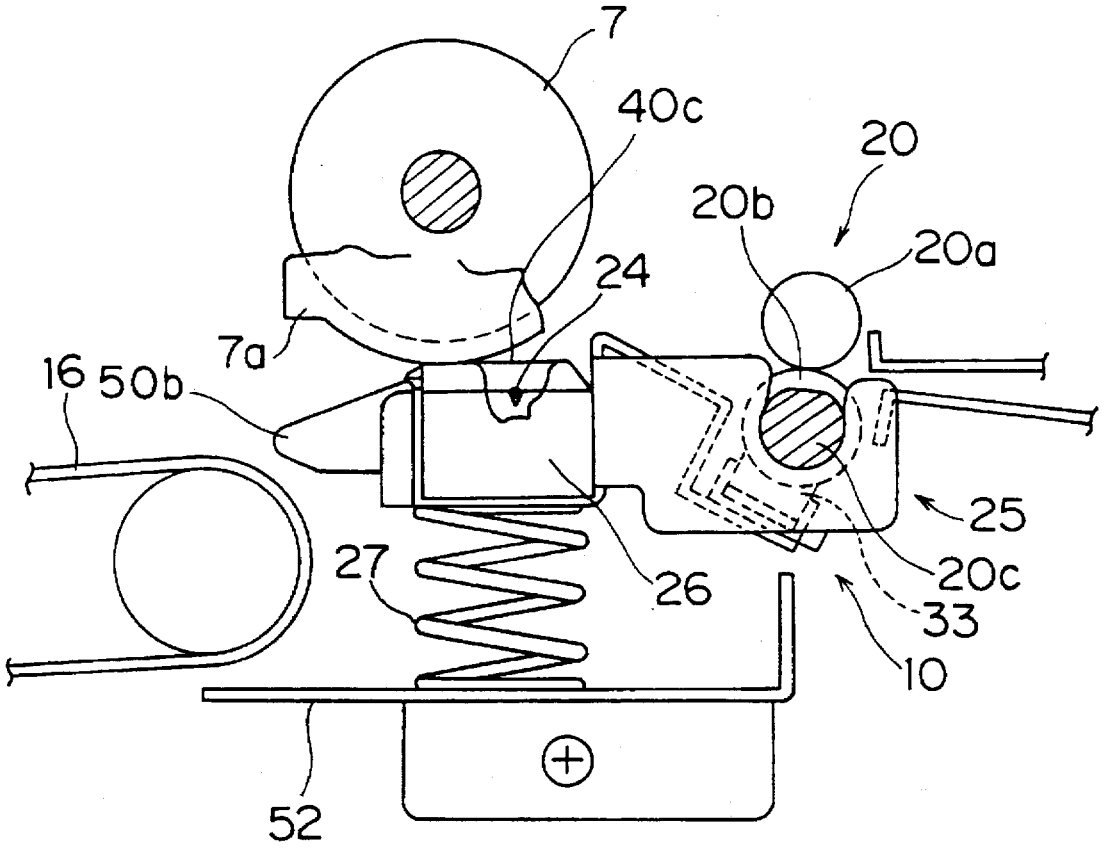
FIG. 3 is a fragmentary, part section, part elevation side view a transfer device of the photocopier depicted in FIG. 1, where the components inside the photocopier are shown on a slightly enlarged scale.

Sheet supply transport device 15 for transporting copy sheets to the transfer device 10 is provided between manual sheet supply tray 4 and sheet supply cassette 12, and the imaging station including the photo-sensitive drum 7, etc. Furthermore, between the imaging station and the discharge tray 5, a sheet discharging device 16, a fixing unit 17 and discharging rollers 18 are located. Registration rollers 20 are further provided, disposed adjacent the photo-sensitive drum 7 on its upstream in the direction of copy sheet flow through the photocopier 1. Registration rollers 20, shown enlarged in FIG. 3, are a pair consisting of an upper roller 20*a* and a lower roller 20*b*. The registration rollers 20 feed to photo-sensitive drum 7 sheets brought by the sheet supply transport device 15 at a predetermined timing.

As shown in FIG. 2, the photocopier 1 is composed of an upper body section 1*a* and a lower body section 1*b*. Upper body section 1*a* is connected to lower body section 1*b* by means of a hinge (not shown, although it is to the right in FIG. 2) on which it freely pivots. Accordingly, upper body section 1*a* can be opened by pivoting it upwards with respect to lower body section 1*b*, as shown in FIG. 2. Herein all components located above photo-sensitive drum 7 are supported within the upper body section 1*a*, and components such as the transfer device 10 and the fixing unit 17 are supported within the lower body section 1*b*.

Transfer device 10 will now be described in detail.

The principal components of transfer device 10, shown in position below photo-sensitive drum 7 in FIG. 3, are a discharge wire 24, disposed to lie in the axial direction of photo-sensitive drum 7, metal shield frame 25, resin housing 26 fitted into this shield frame 25, and bracing spring 27.

Figure 4:
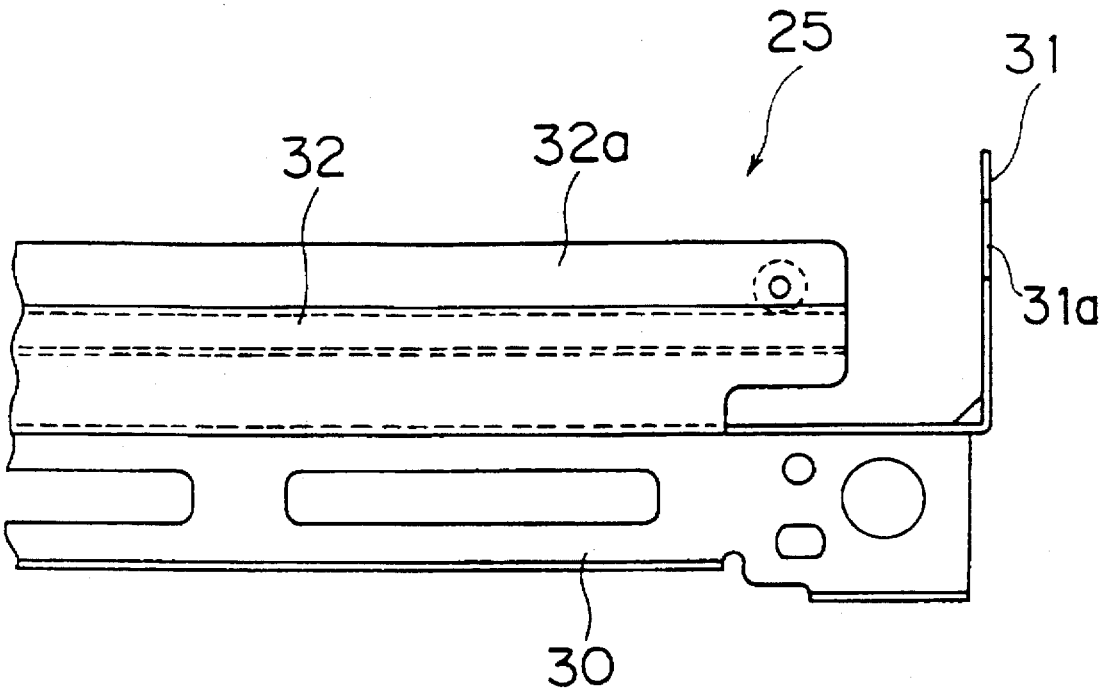
FIG. 4 is a fragmentary top view of a shield frame in the transfer device depicted in FIG. 3, shown removed from the transfer device.
Figure 5:
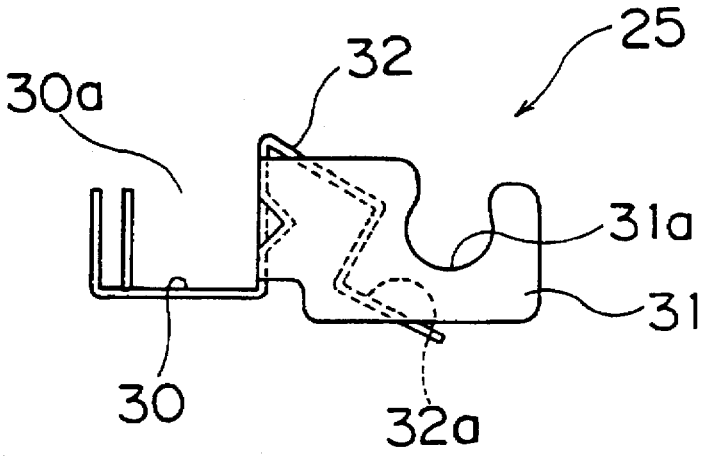
FIG. 5 is a side view of the shield frame depicted in FIG. 4, shown removed from the transfer device depicted in FIG. 3.
Figure 6:
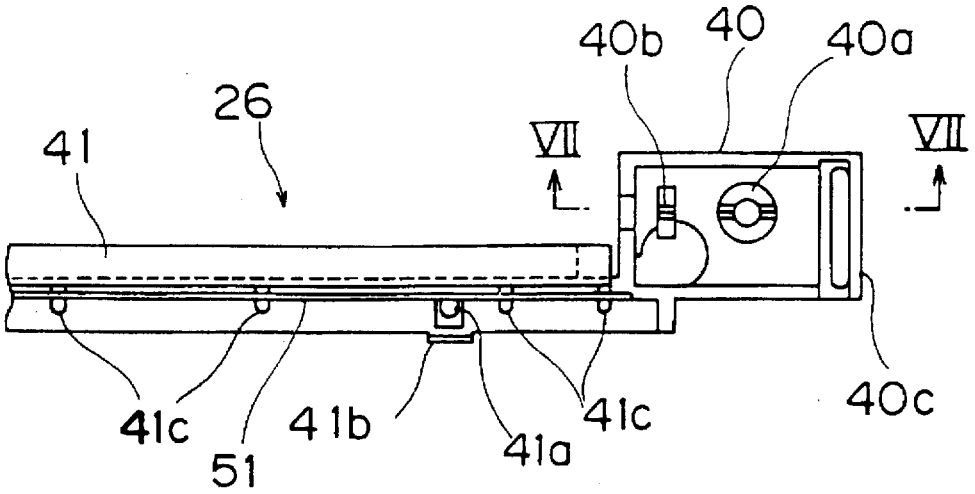
FIG. 6 is a top elevation of a housing associated with the transfer device depicted in FIG. 3, shown removed from the transfer device and looking in the direction of the arrow VII.
Figure 7:
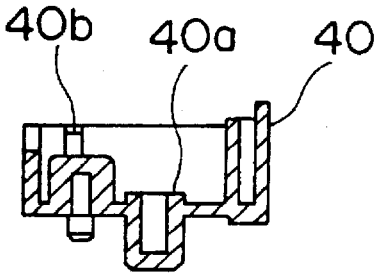
FIG. 7 is a cross section taken through the line VII—VII in FIG. 6 looking in the direction of the arrows.
Figure 8:
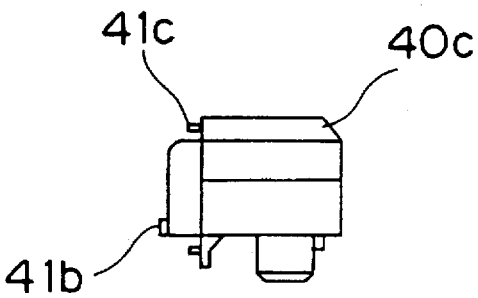
FIG. 8 is a side elevation of the housing depicted in FIGS. 6 and 7.
Figure 9:
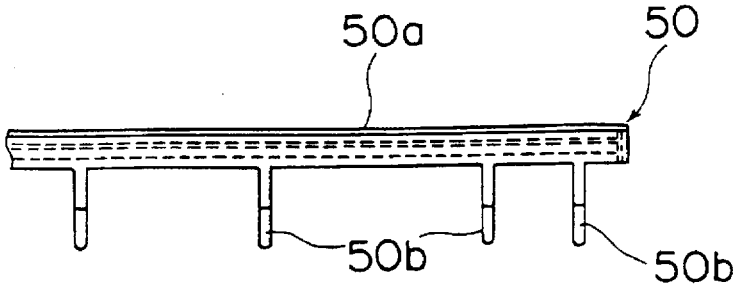
FIG. 9 is a top elevational view, with some features shown in phantom, of a guide member associated with the transfer device depicted in FIG. 3, the guide member shown removed from the transfer device.

Shield frame 25, as shown in FIGS. 3 through 5, consists of a housing mount 30, extending in a direction along the rotational axis of the photo-sensitive drum 7; perpendicular to the sheet flow direction; supports 31 of a pair provided at either end lengthwise of the shield frame 25, extending upstream in the sheet flow direction; and paper dust removing element mount 32, formed projecting down from the top of an upstream wall of housing mount 30, also extending upstream with respect to the sheet flow direction.

Housing mount 30 is formed U-shaped in cross-section so as to surround discharge wire 24, opening upward, (as indicated by reference mark 30*a*), toward the photo-sensitive drum for discharge exposure by the discharge wire 24. An arched engagement notch 31*a* is formed in either support 31, and, as shown in FIG. 3, the notch 31*a* is supported to be freely pivotal about axle 20*c* of the lower roller 20*b* of the pair of registration rollers 20. Furthermore, a fitting portion 32*a* is formed along the lower (upstream) end of paper dust removing element mount 32 at a predetermined distance from lower roller 20*b*. The fitting portion 32*a* moreover, forms a mounting surface substantially parallel to a plane tangent with the lower roller 20*b*. A paper dust removing element 33 (FIG. 3), composed of felt or the like, is fitted to the fitting portion 32*a*. Paper dust removing element 33 is, in the above-described configuration, thus pressed against the circumferential surface of lower roller 20*b*.

Housing 26 is a modular element made of a synthetic resin and, as shown in FIG. 3 and FIGS. 6–8, and 13–14 when mounted extends lengthwise along the axis of photo-sensitive drum 7. Insulating blocks 40 are formed at respective lengthwise ends of housing 26, joined by a shank 41 (or connector) formed integrally between the insulating blocks 40.

Each insulating block 40 includes a mount 40*a* to which respective ends of the discharge wire 24 are connected, and supports 40*b* for supporting the discharge wire 24 before the mounts 40*a*. (Note that the discharge wire 24 is only indicated, endwise, in FIG. 3; whereas for clarity in FIGS. 6 and 7 the discharge wire 24 is not depicted.)

Further, along the top end of an end wall 40*c* on the outermost side of insulating block 40, a flat contact portion is formed. As shown in FIG. 3, lower end of drum housing 7*a* arranged on either end of photo-sensitive drum 7 is abutable on the top edge of the end wall 40*c*. Shank 41 is formed integrally as an extension of the insulating block 40 end wall downstream in the sheet flow direction. Shank 41 is provided with a plurality of pegs 41*a* (only one is shown in location in FIG. 6, while two appear in FIGS. 13 and 14) disposed at predetermined lengthwise spacings. Further, a channel 41*b* is formed beneath each peg 41*a*. Moreover, along the downstream edge of the top of shank 41 a plurality of sheet guide nibs 41*c* for guiding sheets in transport through the transfer device is formed at predetermined lengthwise spacings.

Figure 10:
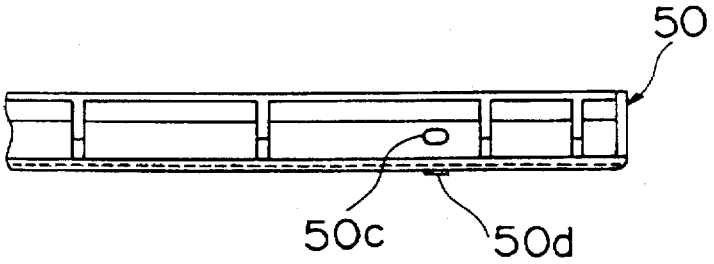
FIG. 10 is a front view of the guide member depicted in FIG. 9.
Figure 11:
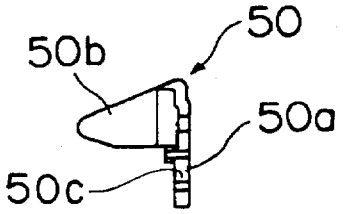
FIG. 11 is a side view of the guide member depicted in FIGS. 9 and 10.
Figure 12:
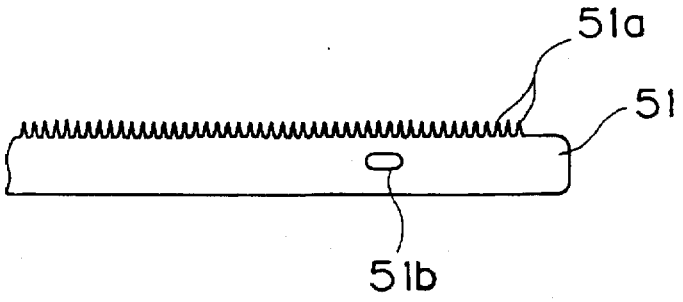
FIG. 12 is a fragmentary front view of a charge removing member associated with the transfer device depicted in FIG. 3, the charge removing member shown removed from the transfer device.
Figure 13:
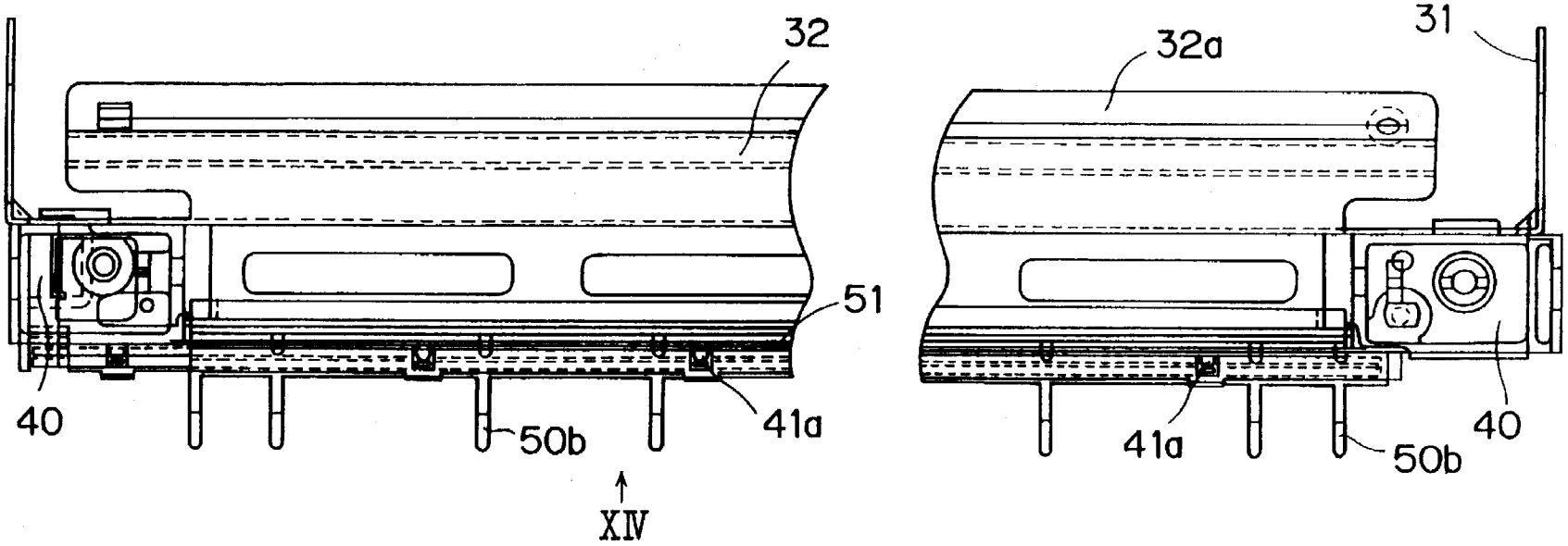
FIG. 13 is a fragmentary top view of the transfer device depicted in FIG. 3, shown removed from the clam-shell type photocopier, shown with the shield frame, the housing, the charge removing member and guide member fully assembled.
Figure 14:
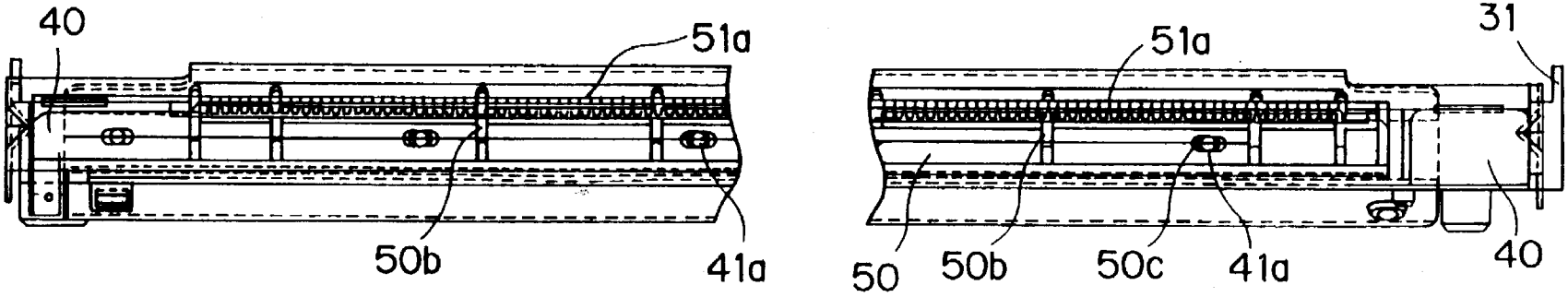
FIG. 14 is a framentary front view of the transfer device depicted in FIG. 13, looking in the direction of the arrow XIV.

A sheet transport guiding element 50, depicted in FIGS. 9–11, and 13–14, attaches to the lateral surface of shank 41 downstream in the sheet flow direction. The guiding element 50 is composed of a wall 50*a* which contacts said lateral surface of shank 41, and guide projections 50*b*. The guide projections 50*b* extend in a downward slope from the upper edge of wall 50*a*, in a substantially triangular form in cross-section as shown in FIG. 11. A plurality of the guide projections 50*b* are provided at predetermined lengthwise spacings. Slots 50*c* are provided in the middle vertically of the wall 50*a* of the sheet transport guiding element 50. FIG. 10 shows locator bosses 50*d* protruding slightly from the bottom of guiding element 50 below the slots 50*c*. Guiding element 50 is fitted to shank 41 by engagement of the pegs 41*a* with the slots 50*c*, and by engagement of the locator bosses 50*d* with the channels 41*b* at the foot of the adjacent lateral surface of shank 41.

In the fitting of guiding element 50 to shank 41, a charge-removing element 51, depicted in FIGS. 6, 12, 13 and 14 is meanwhile sandwiched therebetween. Charge-removing element 51 is a metal plate element extends in the axial direction along the photo-sensitive drum 7. A plurality of needle-like teeth 51*a* (FIG. 12) at predetermined lengthwise spacings is formed projecting upward from the top edge of the charge-removing element 51. Moreover a plurality of slots 51*b* is formed in the middle vertically of the charge-removing element 51, for engagement with the pegs 41*a* of shank 41.

Shield frame 25, housing 26 and sheet transport guiding element 50 of the above-described configuration are freely pivotal about the center of the axle 20*c* on which lower roller 20*b* of the registration rollers 20 is rotational. Bracing spring 27 is provided between a transfer device support frame 52 and the bottom surface of housing mount 30 of shield frame 25. Bracing spring 27 thus braces the downstream ends of shield frame 25 in the sheet flow direction against the adjacent ends of the photo-sensitive drum 7.

Next, an explanation outlining the operation of the photocopier will be given.

An original document is placed on manuscript platform 2, and when the photocopy key is depressed a sheet of paper is fed from sheet supply cassette 12 for example, and sent on to registration rollers 20 via sheet supply transport device 15. At the same time the image data is read from the document by exposure device 6, and an electrostatic latent image is formed superficially on photo-sensitive drum 7 in correspondence with the document image data. This electrostatic latent image is developed by developing device 9 to form a toner image on the surface of photo-sensitive drum 7. Registration rollers 20 send the sheet to the photo-sensitive drum 7 in synchrony with the rotation of photo-sensitive drum 7. When a sheet is fed between photo-sensitive drum 7 and transfer device 10, a high voltage is applied to the discharge wire 24 of transfer device 10, by which means a corona discharge is generated on the rear surface of the sheet, inducing transfer of the toner image on the surface of photo-sensitive drum 7 to the sheet. At the same time an AC voltage is applied to charge-removing element 51, and by this means the electrical charge on the sheet is removed to separate the sheet from photo-sensitive drum 7.

The sheet on which the toner image has been transferred is sent to fixing unit 17 by sheet discharging device 16. In fixing unit 17 the toner image is fixed onto the sheet, and the copy-processed sheet is then discharged into discharge tray 5 by means of the discharging rollers 18.

Meanwhile, a predetermined gap is maintained between photo-sensitive drum 7 and transfer device 10 by the contact between drum housing 7*a* and the contact portion of the end walls 40*c* of housing 26.

In the above embodiment the invention has been applied to a photocopier, but it may be also be applied in the same way to facsimile devices, printers or the like.

With the invention as described above, since the insulating blocks which support the discharge wire and the connector on which the charge removing member is fitted are formed integrally, the gap between the discharge wire and the charge removing member can easily be set to a high degree of accuracy. As a result, even if the discharge wire and charge removing member are located within a narrow space, it is possible to suppress any adverse effect on the image due to the voltage applied to the charge removing member. Moreover, the gap between the image holder and the charge removing member can easily be set to a high degree of accuracy.

In addition, since one end of the shield frame is supported so as to be freely pivotable about the lower registration roller, and movement of its free end determined by the positioning mechanism, the required gap can easily be maintained between the image holder and the discharge wire.

Furthermore, since the other end of the housing is urged against the image producing element, and further since the housing and the image holder are positioned so as to be in contact with one another, the gap between the discharge wire and the image holder can be maintained at a specific interval with a simple structure.

Moreover, since the charge removing member is fixed between the connector and the guide member, it is easy to fit the charge removing member.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed:

1. An image reproducing device comprising:

a frame;

an image forming element supported within said frame;

a sheet supply device supported in said frame for transporting sheets to the image forming element;

a transfer device disposed approximately between said sheet supply device and said image forming element, said transfer device comprising:

a shield frame supported within the image reproducing device;

a housing formed with a pair of insulating blocks and a connector extending between said insulating blocks, said connector and said insulating blocks formed integrally as a single element, said housing supported within a portion of said shield frame;

a discharge wire extending between said insulating blocks and supported thereby, said discharge wire positioned proximate the image forming element, and a portion of said shield frame shaped to at least partially surround said discharge wire; and a charge removing member fitted to said connector.

2. The image reproducing device as in claim 1, further comprising:

a registration roller supported in said frame such that a portion of said shield frame engages said registration roller such that said shield frame is constrained for limited pivotal movement about said registration roller; and a positioning mechanism within said frame which supports said shield frame for limited pivotal movement about said registration roller maintaining a predetermined gap between said image forming element and said discharge wire.

3. The image reproducing device as in claim 2 wherein said positioning mechanism engages a contact part formed in a portion of said housing and said positioning mechanism contacts a portion of the image forming element, and said positioning mechanism also includes a spring member which urges the housing and said shield frame toward the image forming element.

4. The image reproducing device as in claim 2 wherein said frame comprises:

a lower body part which supports said transfer device; and an upper body part hinged to said lower body part, said upper body part supporting said image forming element.

5. The image reproducing device as in claim 1 wherein said transfer device further comprises a sheet transport guide member fitted to said connector so as to be freely removable, said charge removing member being supported between said connector and said sheet transport guide member.

6. An image reproducing device comprising:

a frame having a lower body part and an upper body part configured to open and close freely with respect to said lower body part;

an image data capturing means supported within said frame which captures image data, an image-forming part supported in said upper body part which includes a photosensitive drum;

a sheet supply device within said lower body part which supplies sheets to the image-forming part;

a transfer device body supported in said lower body part positioned to be opposite said photosensitive drum when said upper body part is in a closed position with respect to said lower body part, said transfer device body configured to pivot about a registration roller supported in said lower body part;

a positioning mechanism within said lower body part which supports said transfer device body;

a fixing device supported in said lower body part downstream of said transfer device body;

wherein said transfer device body comprises:

a shield frame supported within the image reproducing device;

a housing formed with a pair of insulating blocks and a connector extending between said insulating blocks, said connector and said insulating blocks formed integrally as a single element, said housing supported within a portion of said shield frame;

a discharge member extending between said insulating blocks and supported thereby, said discharge wire positioned proximate the image forming element, and a portion of said shield frame shaped to at least partially surround a discharge wire; and a charge removing member fitted to said connector;

and wherein said positioning mechanism maintains a predetermined gap between said photosensitive drum and said discharge wire.

* * * * *